US008876124B2

(12) United States Patent
Pokupec

(10) Patent No.: US 8,876,124 B2
(45) Date of Patent: Nov. 4, 2014

(54) ICE SKATE OVERSHOE

(71) Applicant: Douglas Pokupec, Burlington (CA)

(72) Inventor: Douglas Pokupec, Burlington (CA)

(73) Assignee: Douglas Pokupec, Burlington, Ontario ( * ) Notice: Subject to any disclaimer, the term of this patent is extended or adjusted under 35 U.S.C. 154(b) by 64 days.

(21) Appl. No.: 13/573,984

(22) Filed: Oct. 18, 2012

(65) Prior Publication Data

US 2014/0110909 A1 Apr. 24, 2014

(51) Int. Cl.

| | |
|---|---|
| ***A63C 1/00*** | (2006.01) |
| ***A63C 9/00*** | (2012.01) |
| ***A63C 1/24*** | (2006.01) |
| ***A63C 1/42*** | (2006.01) |
| ***A63C 1/36*** | (2006.01) |
| ***A43B 5/18*** | (2006.01) |

(52) U.S. Cl.

CPC ... *A63C 1/00* (2013.01); *A63C 1/24* (2013.01); *A63C 1/42* (2013.01); *A63C 1/36* (2013.01); *A43B 5/18* (2013.01)

USPC ..... 280/11.3; 280/11.12; 280/28

(58) Field of Classification Search

CPC ..... A63C 1/00; A63C 9/00

USPC ..... 280/11.12, 11.3, 28

See application file for complete search history.

(56) References Cited

U.S. PATENT DOCUMENTS

| | | | | |
|---|---|---|---|---|
| 54,344 A | | 5/1866 | Hibler | |
| 155,533 A | | 9/1874 | Luce | |
| 609,401 A | | 8/1898 | Beisel | |
| 672,756 A | | 4/1901 | Everett | |
| 1,444,673 A | | 2/1923 | Eames | |
| 3,199,883 A | | 8/1965 | Freeman | |
| 3,415,528 A | * | 12/1968 | Herold | 280/11.12 |
| 3,879,047 A | * | 4/1975 | MacDonald | 280/11.12 |
| 5,462,295 A | * | 10/1995 | Seltzer | 280/11.19 |
| 7,641,203 B1 | | 1/2010 | Carey et al. | |
| 2008/0100008 A1 | * | 5/2008 | Wan | 280/11.18 |
| 2010/0314844 A1 | | 12/2010 | Spah | |

OTHER PUBLICATIONS

U.S. Appl. No. 13/507,609, filed Jul. 14, 2012, Douglas Pokupec.
U.S. Appl. No. 13/573,225, filed Aug. 31, 2012, Douglas Pokupec.

* cited by examiner

*Primary Examiner* — Hau Phan
*Assistant Examiner* — Bryan Evans

(57) ABSTRACT

An ice skate overshoe includes; an upper portion; a sole connected to the upper portion; a blade connected to the sole; where the upper portion is made substantially of stretchable rubber; where the upper portion is configured stretchable and capable to return substantially to its original state; where the upper portion comprises a first opening configured as an entrance for a footwear; where the upper portion is configured to stretch over the footwear to secure the ice skate overshoe to the footwear; where the sole is configured to support a footwear bottom; where the sole is configured substantially rigid; where the blade is configured substantially rigid; where the blade is rigidly attached to the sole; where the blade is configured operable to engage with an ice surface; where the ice skate overshoe is configured to wear over the footwear; and where the ice skate overshoe is configured operable to skate on the ice surface.

7 Claims, 15 Drawing Sheets

ICE SKATE OVERSHOE

BACKGROUND

Generally, the present invention relates to footwear. More particularly, the present invention relates to footwear used for skating on an ice surface.

SUMMARY OF THE INVENTION

Embodiments of the present invention provide a footwear for skating on an ice surface.

According to an embodiment of the present invention, an ice skate overshoe comprises: an upper portion, a sole connected to the upper portion, and a blade connected to the sole. The upper portion is made substantially of stretchable rubber. The upper portion is configured stretchable and capable to return substantially to its original state. The upper portion comprises a first opening configured as an entrance for a footwear. The upper portion is configured to stretch over the footwear to secure the ice skate overshoe to the footwear. The sole is configured to support a footwear bottom. The sole is configured substantially rigid. The blade is configured substantially rigid. The blade is rigidly attached to the sole. The blade is configured operable to engage with an ice surface. The ice skate overshoe is configured to wear over the footwear and the ice skate overshoe is configured operable to skate on the ice surface.

In one aspect, the upper portion is formed substantially as a single part manufactured from a moldable rubber. In one aspect, the upper portion is an open frame construction, wherein the upper portion comprises a plurality of second openings configured to add stretchability to the upper portion. In one aspect, the upper portion comprises an upper portion base formed as a single part with the upper portion and manufactured from a moldable rubber. In one aspect, the first opening is located preferably at the top of the upper portion. In one aspect, at least a top portion of the upper portion is configured to stretch tightly over the footwear. In one aspect, the upper portion is made substantially of a thermoplastic elastomer. In one aspect, the upper portion is molded to the sole to secure the upper portion to the sole. In one aspect, the upper portion is bonded to the sole to secure the upper portion to the sole. In one aspect, the upper portion comprises a front toe portion formed as a single part with the upper portion and manufactured from a moldable rubber, and the front toe portion is configured to stretch over the toe area of the footwear. In one aspect, the ice skate overshoe comprises a raised protrusion area configured capable to provide grip to the footwear bottom, and wherein the raised protrusion area is located in at least one of, the top surface of the upper portion base, or located on the top surface of the sole, and wherein the raised protrusion area may be formed as a single part with the upper portion and manufactured from a moldable rubber. In one aspect, the upper portion comprises a pull tab located and attached to the rear of the upper portion and configured capable to be pulled by a hand to stretch the upper portion to increase the size of the first opening for the entrance of the footwear. In one aspect, the ice skate overshoe comprises at least two of the blade located substantially parallel to each other and configured capable to skate on the ice surface. In one aspect, the sole and the blade are formed as a single part manufactured from at least one of a metal, a plastic, and a composite. In one aspect, the sole comprises a blade holder, the blade holder configured to connect the blade to the sole. In one aspect, the sole and the blade holder are formed as a single part manufactured from at least one of a metal, a plastic, and a composite. In one aspect, the blade holder is molded to the blade to secure the blade to the blade holder. In one aspect, the sole comprises a plurality of sole openings configured to be penetrated by the material of the upper portion. In one aspect, the sole comprises a heel support configured to support the rear of the footwear. In one aspect, the sole comprises a toe support configured to support the front of the footwear. In one aspect, the sole comprises a second leading edge radius and a second trailing edge radius In one aspect, the sole comprises an outer perimeter radius. In one aspect, the sole is made of at least one of a metal, a plastic, a composite, and a rubber. In one aspect, the blade comprises a blade height measurement, the blade height measurement may be variable, and the blade height measurement is less than approximately thirty millimeters, measured from a sole bottom surface to a blade bottom surface. In one aspect, the blade comprises a blade width measurement between two millimeters and fifteen millimeters. In one aspect, the blade comprises a plurality of blade openings configured to be penetrated by the material of the blade holder. In one aspect, the blade comprises a first leading edge radius and a first trailing edge radius. In one aspect, the blade bottom surface of the blade comprises at least one of, a flat contact profile, a concave contact profile, and a round contact profile. In one aspect, the blade is made of at least one of, a metal, a plastic, a composite, a spring metal, and a stainless steel metal.

In one aspect, a method to transition from a walking state or a running state on a non-ice surface to a skating state on the ice-surface, comprises:

providing the ice skate overshoe and the footwear, wherein the footwear is operable for the walking state or the running state on the non-ice surface; and connecting the ice skate overshoe over the footwear.

In one aspect, a method to manufacture an ice skate overshoe, provided with an upper portion, a sole connected to the upper portion, and a blade connected to the sole, comprises the steps of: mold the upper portion; manufacture the blade; align the blade into a sole and blade holder mold; mold the sole and the blade holder to the blade; align the upper portion to the sole; and bond the upper portion to the sole;

In one aspect, a method to manufacture an ice skate overshoe, provided with an upper portion, a sole connected to the upper portion, a blade holder connected to the sole, and a blade connected to the blade holder, comprises the steps of: manufacture the blade; align the blade into a sole and blade holder mold; mold the sole and the blade holder to the blade; align the sole and the blade holder and the blade to the upper portion mold; and mold the upper portion to the sole;

DETAILED DESCRIPTION

In the following description, the use of "a", "an", or "the" can refer to the plural. All examples given are for clarification only, and are not intended to limit the scope of the invention.

The term "ice skate overshoe" is used to describe an ice skate which is typically worn over a persons footwear for skating on an ice surface but not limited to this.

The term "footwear" is known in the art and is used to describe an item which typically is worn on a persons foot for walking and running but not limited to these. "Footwear" may refer to items worn on a persons foot such as shoes, athletic shoes, dress shoes, skateboard shoes, and boots but not limited to these.

The term "ice surface" is known in the art and is used to describe a surface with ice used for ice skating which may include an ice rink, an indoor ice arena, an outdoor ice arena, a frozen lake, and a frozen pond, but not limited to these. It may also refer to a synthetic ice surface.

The term "rubber" is known in the art. It may also refer to natural rubber, synthetic rubber, an elastomer, or a thermoplastic elastomer.

The term "open frame" may refer to a skeleton frame, a frame with openings, a structure with openings, or a structural system with openings.

An advantage to the embodiments shown is that the ice skate overshoe may be worn over a persons footwear. Another advantage to the embodiments shown is that the ice skate overshoe may have a low profile blade. Another advantage to the embodiments shown is that the ice skate overshoe may have a plurality of blades.

It is understood that any ordinary person skilled in the art understands that the blade of a footwear used for skating may be arranged in many configurations which influences the characteristics for skating.

Figure 1A:
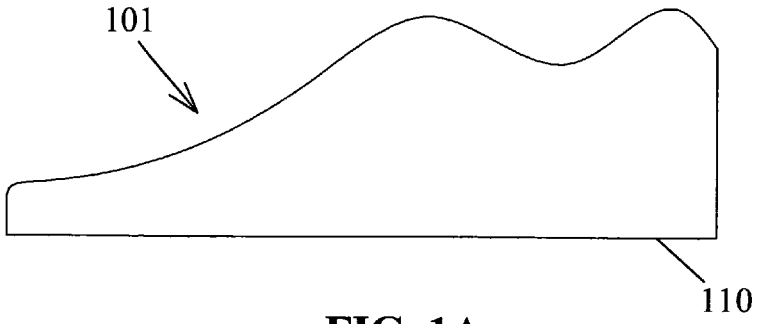
FIG. 1A is a side view of the footwear.
Figure 1B:
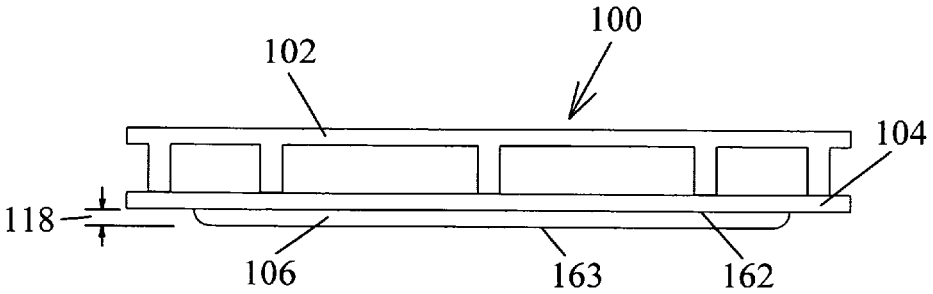
FIG. 1B is a side view of the ice skate overshoe according to a preferred embodiment.
Figure 1C:
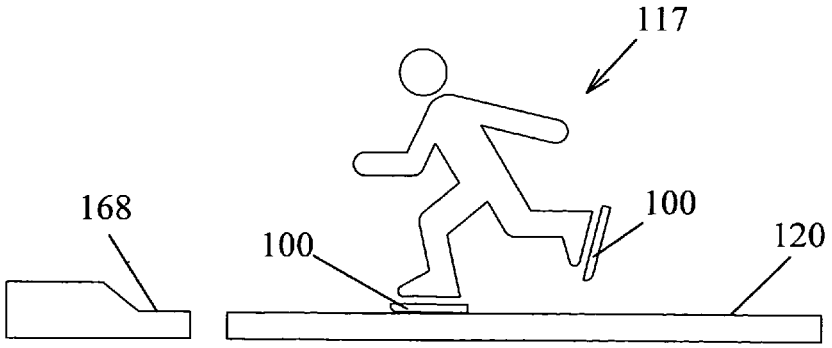
FIG. 1C is a side view that illustrates using the ice skate overshoe on the ice surface.

Referring to FIGS. 1*a*, 1*b*, and 1*c*, according to an embodiment, an ice skate overshoe 100 includes an upper portion 102, a sole 104 connected to the upper portion 102, and a blade 106 connected to the sole 104. The upper portion 102 is made substantially of stretchable rubber. The upper portion 102 is configured stretchable and capable to return substantially to its original state. The upper portion 102 may be formed substantially as a single part manufactured from a moldable rubber. The upper portion 102 may be made substantially of a thermoplastic elastomer. An advantage of a thermoplastic elastomer may include the material characteristics wherein the material may be stretchable and capable to return substantially to its original state at the low temperatures associated with ice skating. The material characteristics may include the ability of not to dry out or crack at the low temperatures associated with ice skating. The upper portion 102 comprises a first opening 103 (shown in FIG. 3) configured as an entrance for a footwear 101. The upper portion 102 is configured to stretch over the footwear 101 to secure the ice skate overshoe 100 to the footwear 101. It is preferable that a substantial portion of the upper portion 102 is configured to stretch tightly over the footwear 101 or at least a top portion of the upper portion 102 is configured to stretch tightly over the footwear 101 to secure the ice skate overshoe 100 to the footwear 101. The upper portion 102 is preferably an open frame construction. The open frame upper portion 102 may facilitate a secure and reliable fit over a wide range of footwear 101 sizes, types, shapes, and styles. At least portions of the upper portion 102 are configured capable of a tension fit with the footwear 101. The sole 104 is configured to support a footwear bottom 110. A contact fit of a substantial portion of the footwear bottom 110 to the sole 104 is preferable. The sole 104 may include a layer of rubber bonded to the top surface of the sole 104. This layer of rubber may be considered as part of the upper portion 102. It may also be considered as part of the sole 104. If included, the contact fit would then be between the footwear bottom 110 to the layer of rubber bonded to the top of the sole 104. The sole 104 is configured substantially rigid. The blade 106 is configured substantially rigid. The blade 106 is rigidly attached to the sole 104. The blade 106 comprises a blade height measurement 118. The blade height measurement 118 is measured from a sole bottom surface 162 to a blade bottom surface 163. The sole 104 is preferably configured substantially flat to accommodate a wide range of footwear 101 sole bottoms. It may comprise some curvatures. The sole bottom surface 162 refers to the substantial flat portion of the bottom surface of the sole 104. The bottom surface of the sole 104 may include an outer layer of rubber formed as part of the upper portion 102. The blade height measurement 118 may refer to a measurement from the mentioned outer layer of rubber below the sole bottom surface 162 to the blade bottom surface 163. The blade bottom surface 163 is the surface of the blade 106 which is configured to contact the ice surface 120. It is preferable that the blade height measurement 118 is measured from the mid length of the blade 106 to the sole bottom surface 162. The blade height measurement 118 is preferably less than approximately thirty millimeters. The blade height measurement 118 may be variable in measurement throughout the length of the blade 106.

This may be variable due to a curvature of the blade bottom surface 163 along the length of the blade 106. These curvatures or blade profiles are known in the art. The blade 106 is configured operable to engage with an ice surface 120. The ice skate overshoe 100 is configured to wear over the footwear 101 and the ice skate overshoe 100 is configured operable to skate on the ice surface 120. A person is capable to transition from a walking state or a running state on a non-ice surface 168 to a skating state 117 on the ice-surface 120, with connecting the ice skate overshoe 100 over the wearer's footwear 101.

FIG. 1*c* illustrates a method to transition from the walking state or the running state on the non-ice surface 168 to the skating state 117 on the ice-surface 120, comprising the ice skate overshoe 100 and the footwear 101, wherein the footwear 101 is operable for the walking state or the running state on the non-ice surface 168, and connecting the ice skate overshoe 100 over the wearer's footwear 101.

Figure 2:
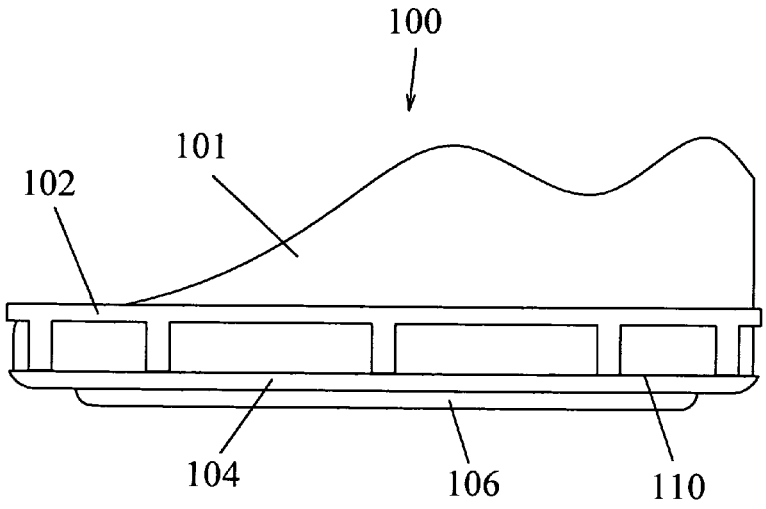
FIG. 2 is a side view of the ice skate overshoe according to a preferred embodiment.

Referring to FIG. 2, according to an embodiment, the ice skate overshoe 100 includes the upper portion 102, the sole 104 connected to the upper portion 102, and the blade 106 connected to the sole 104. The upper portion 102 is made substantially of stretchable rubber. The upper portion 102 is configured stretchable and capable to return substantially to its original state. The upper portion 102 is configured to stretch over the footwear 101 to secure the ice skate overshoe 100 to the footwear 101. The ice skate overshoe 100 is shown stretched over and secured to the footwear 101. The upper portion 102 is shown stretched over the lower portion of the footwear 101 and around the perimeter of the footwear 101. The upper portion 102 may be configured to stretch over the entire perimeter of the footwear 101 or a portion of the perimeter of the footwear 101. The upper portion 102 may be configured to stretch over or wrap around areas of a wearer's footwear 101 which may include a sole, a heel, a heelcap, a toe region, a toe cap, a toe box, a throat, a tongue, and an upper but not limited to these. These areas are known in the art. The upper portion 102 may be configured to cover a portion of the wearers footwear 101 and may range from as little as twenty percent coverage to more than one hundred percent coverage of the wearer's footwear 101. The upper portion 102 is preferably the open frame construction. It may include portions that are closed such as a closed toe portion that wraps around the wearer's footwear 101. The open frame construction upper portion 102 may facilitate a secure and reliable fit over a wide range of footwear 101 sizes, types, shapes, and styles. At least portions of the upper portion 102 are configured capable of a tension fit with the footwear 101. The sole 104 is configured to support the footwear bottom 110. The sole 104 is shown in contact with the footwear bottom 110. A contact fit of a substantial portion of the footwear bottom 110 to the sole 104 is preferable. The footwear bottom 110 is considered the bottom surface of the sole of the footwear 101.

Figure 3:
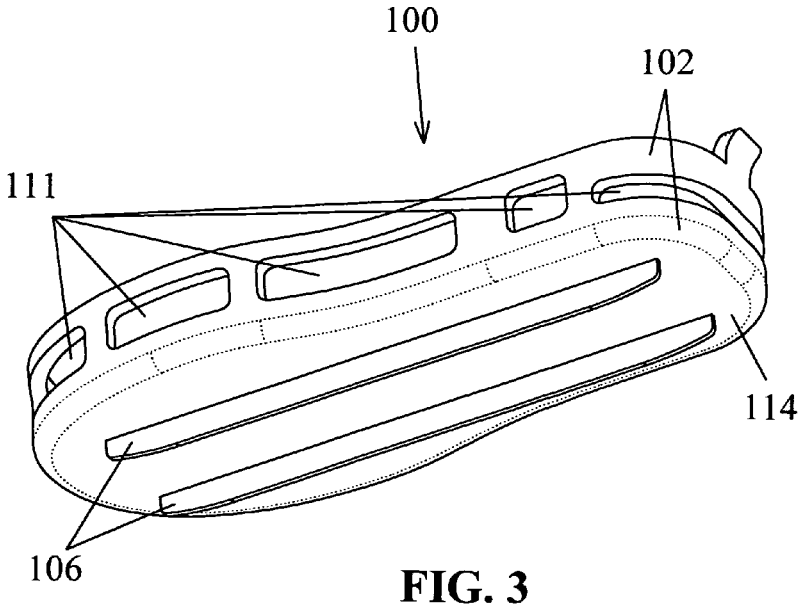
FIG. 3 is a perspective view of the bottom of the ice skate overshoe according to a preferred embodiment.

Referring to FIG. 3, according to an embodiment, the ice skate overshoe 100 includes the upper portion 102, the sole 104 (not shown) connected to the upper portion 102, and the blade 106 connected to the sole 104 (not shown). The upper portion 102 is the open frame construction, wherein the upper portion 102 comprises a plurality of second openings 111 configured to add stretchability to the upper portion 102. The upper portion 102 further comprises an upper portion base 114 formed as a single part with the upper portion 102 and manufactured from a moldable rubber. The upper portion base 114 is a base portion of the upper portion 102. It is preferable that the upper portion base 114 is substantially flat. The upper portion base 114 is preferably made of the same material as the upper portion 102. The upper portion base 114 is connected to the sole 104 (not shown) and substantially follows the shape and contour of the sole 104 in which it is connected to. The upper portion base 114 may be bonded or molded to the sole 104. The bottom of the sole 104 (not shown) is covered with a layer of rubber as part of the upper portion base 114. The ice skate overshoe 100 is shown with two of the blade 106 extending out of the rubber of the upper portion base 114.

Figure 4A:
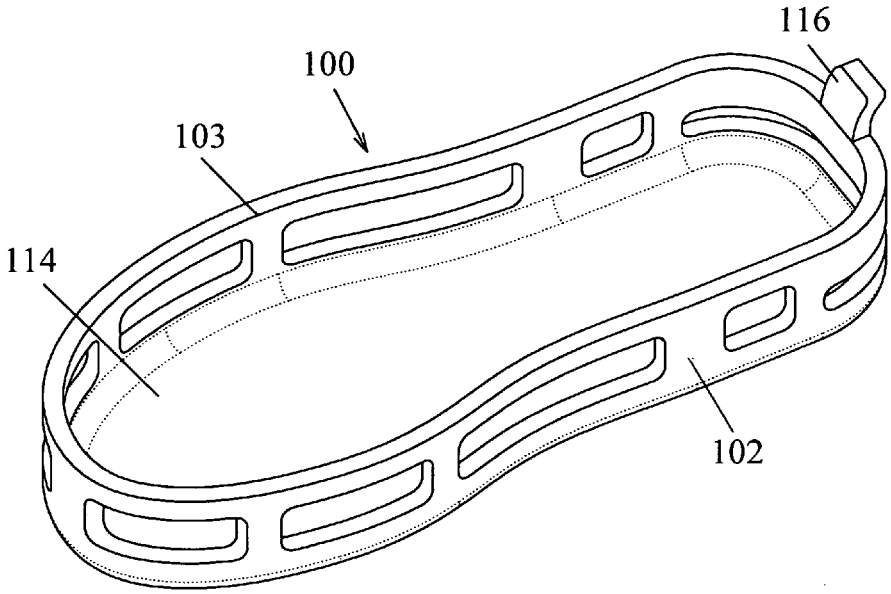
FIG. 4A is a perspective view of the top of the ice skate overshoe according to a preferred embodiment.

Referring to FIG. 4*a*, according to an embodiment, the upper portion 102 of the ice skate overshoe 100 includes the upper portion base 114 connected to the upper portion 102. The upper portion 102 further comprises the first opening 103 configured as the entrance for the wearer's footwear 101 (shown in FIG. 1*a*). The first opening 103 is located preferably at the top of the upper portion 102. The upper portion 102 further comprises a pull tab 116 located and attached to the rear of the upper portion 102 and configured capable to be pulled by a hand to stretch the upper portion 102 to increase the size of the first opening 103 for the entrance of the wearer's footwear 101. It is preferable that the pull tab 116 is formed as a single part with the upper portion 102 manufactured from a moldable rubber.

Figure 4B:
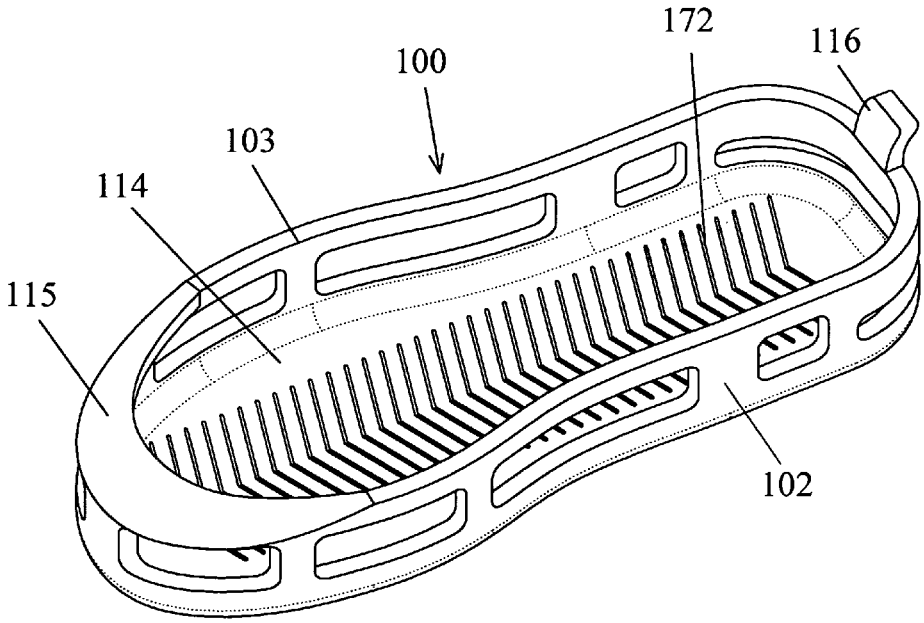
FIG. 4B is a perspective view of the top of the ice skate overshoe according to a preferred embodiment.

Referring to FIG. 4*b*, according to an embodiment, the upper portion 102 of the ice skate overshoe 100 comprises the upper portion base 114, the first opening 103, and the pull tab 116. The upper portion 102 may further comprise a raised protrusion area 172 formed as a single part with the upper portion 102 and manufactured from a moldable rubber, wherein the raised protrusion area 172 is located on the top of the upper portion base 114 and configured capable to provide grip to the footwear bottom 110 (shown in FIG. 1*a*). The upper portion 102 may further comprise a front toe portion 115 formed as a single part with the upper portion 102 and manufactured from a moldable rubber, and wherein the front toe portion 115 is configured to stretch over the toe area of the footwear 101. The front toe portion 115 may be the open frame construction or a closed construction.

Figure 5A:
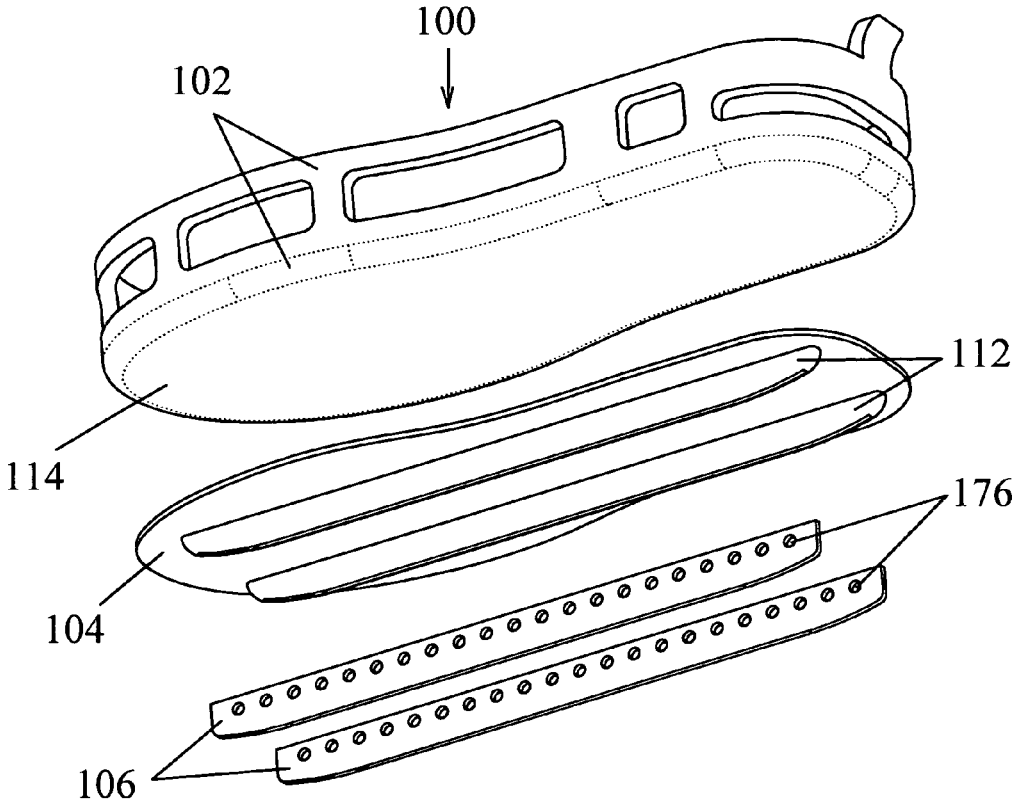
FIG. 5A is a perspective exploded view of the bottom of the ice skate overshoe according to a preferred embodiment.

FIG. 5*a* is an exploded perspective view of the bottom of the ice skate overshoe 100 according to an embodiment. The ice skate overshoe 100 comprises the upper portion 102, the upper portion base 114, the sole 104, and the blade 106. The sole 104 further comprises a blade holder 112, the blade holder 112 configured to connect the blade 106 to the sole 104. The sole 104 and the blade holder 112 are preferably formed as a single part manufactured from at least one of a metal, a plastic, and a composite. The blade holder 112 is preferably molded to the blade 106 to secure the blade 106 to the blade holder 112. An injection molding process is preferable if the blade holder 112 is made from a plastic. The blade holder 112 is molded around a portion of the blade 106 with a portion of the blade 106 left exposed such as at least the blade bottom surface 163 (shown in FIG. 1*b*). The blade 106 may comprise a plurality of blade openings 176 configured to be penetrated by the material of the blade holder 112. The blade 106 may alternatively or in addition be secured to the blade holder 112 with fasteners or with bonding. The blade holder 112 and the sole 104 may alternatively be manufactured separately and bonded together afterwards with fasteners or adhesives. The methods for attachment of the blade 106 to the blade holder 112 and the blade holder 112 to the sole 104 are known in the art. Other methods may be included.

Figure 5B:
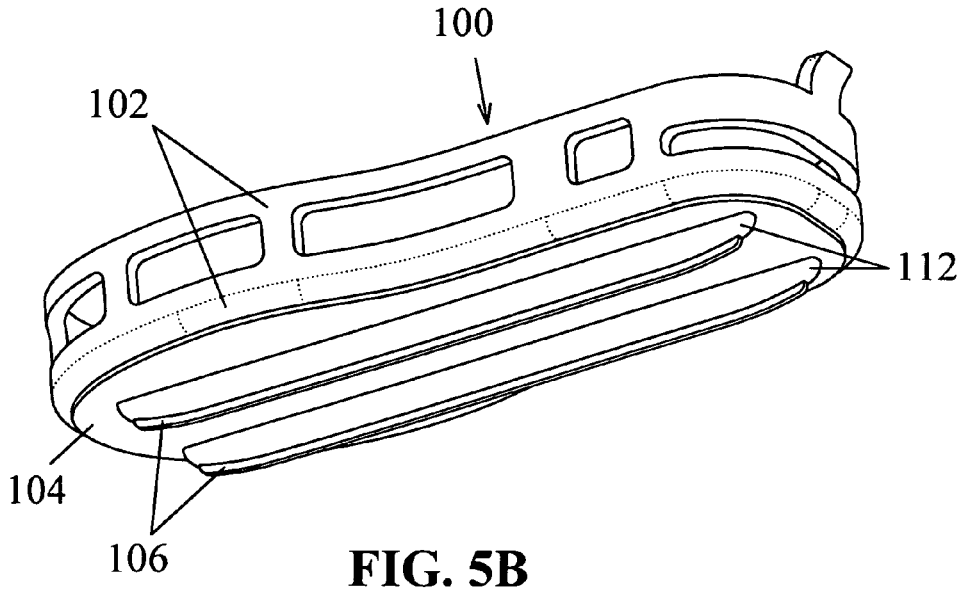
FIG. 5B is a perspective view of the bottom of the ice skate overshoe according to a preferred embodiment.

FIG. 5*b* is a perspective view of the bottom of the ice skate overshoe 100 according to an embodiment. The ice skate overshoe 100 comprises the upper portion 102, the upper portion base 114 (not shown), the sole 104, and the blade 106. The sole 104 further comprises the blade holder 112. The assembly of the sole 104 shown includes the sole 104, the blade holder 112, and the blade 106. The top surface of the sole 104 is secured to the bottom surface of the upper portion base 114. The sole 104 may be secured to the upper portion 102 with at least one of, an adhesive bonding process, a molding process, a vulcanization process or with an injection molding process. These are known in the art. Other processes may be included.

Figure 5C:
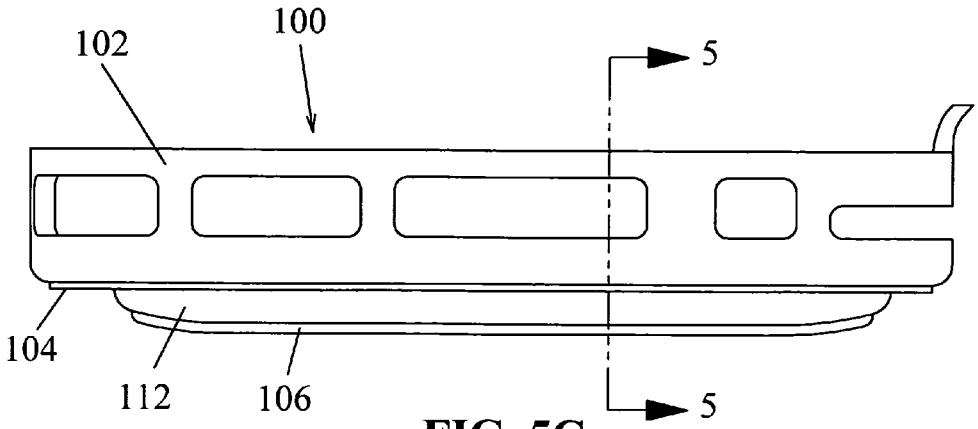
FIG. 5C is a side view of the ice skate overshoe according to a preferred embodiment.

FIG. 5*c* is a side view of the ice skate overshoe 100 according to a preferred embodiment. The ice skate overshoe 100 comprises the upper portion 102, the upper portion base 114 (shown in FIG. 5*d*), the sole 104, the blade holder 112, and the blade 106. The ice skate overshoe 100 is shown where a cross sectional cut is taken and viewed in FIG. 5*d*.

Figure 5D:
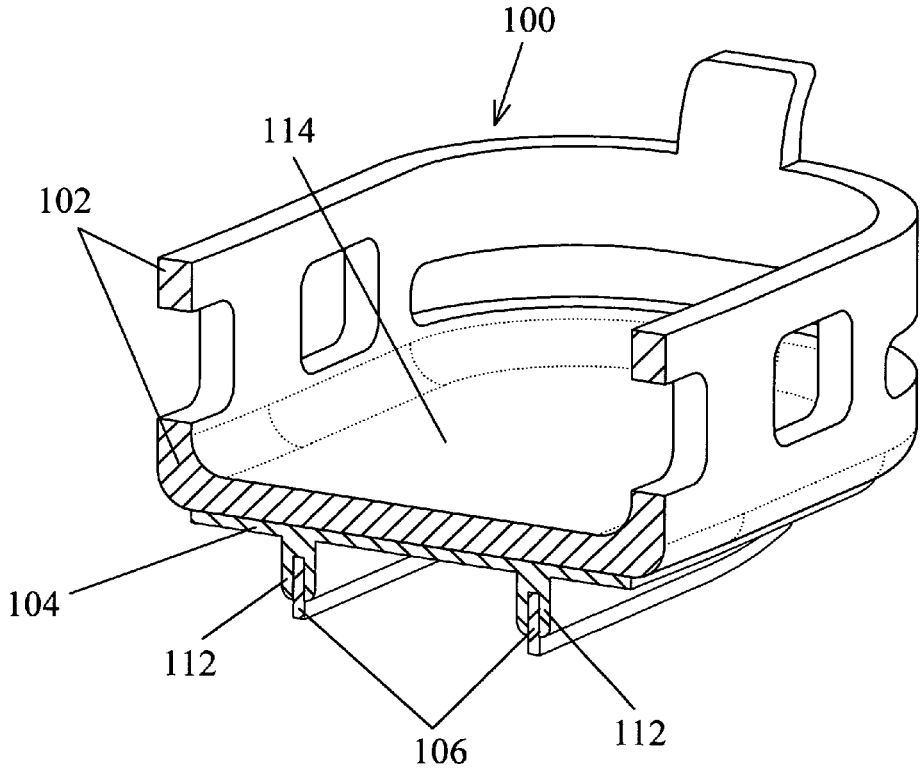
FIG. 5D is a perspective sectional view of the ice skate overshoe according to a preferred embodiment.

FIG. 5*d* is a perspective cross sectional view of the ice skate overshoe 100 according to an embodiment. The ice skate overshoe 100 comprises the upper portion 102, the upper portion base 114, the sole 104, and the blade 106. The sole 104 further comprises the blade holder 112. The sole 104 and the blade holder 112 are preferably formed as a single part. The top surface of the sole 104 is secured to the bottom surface of the upper portion base 114. The upper portion 102 includes the upper portion base 114, the upper portion 102 and the upper portion base 114 are preferably formed as a single part and manufactured from a moldable rubber. The sole 104 may be secured to the upper portion 102 with at least one of, an adhesive bonding process, a molding process, a vulcanization process or with an injection molding process. These are known in the art. Other processes may be included.

Figure 6A:
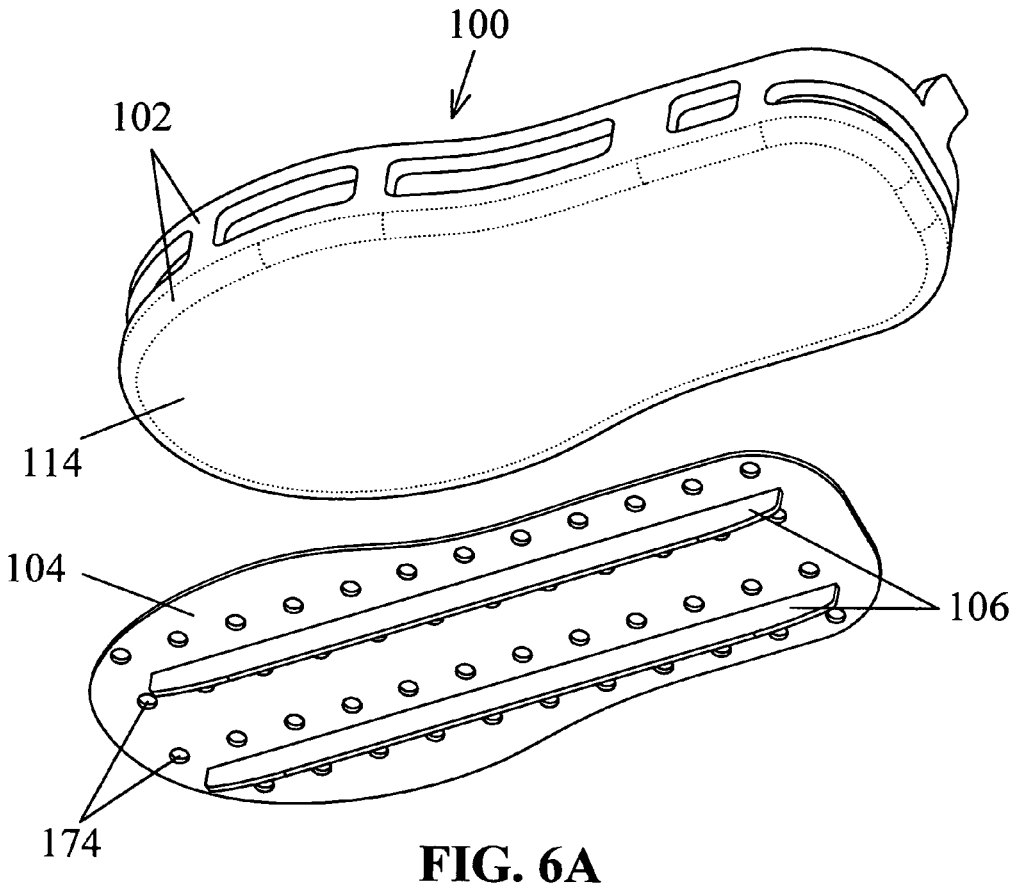
FIG. 6A is a perspective exploded view of the bottom of the ice skate overshoe according to a preferred embodiment.

FIG. 6*a* is an exploded perspective view of the bottom of the ice skate overshoe 100 according to an embodiment. The ice skate overshoe 100 comprises the upper portion 102, the upper portion base 114, the sole 104, and the blade 106. The sole 104 further comprises a plurality of sole openings 174 configured to be penetrated by the material of the upper portion 102. The sole openings 174 are configured to improve the connection of the sole 104 to the upper portion base 114. The sole openings 174 are through openings through the sole 104. The sole 104 may also include blind openings or serrations.

Figure 6B:
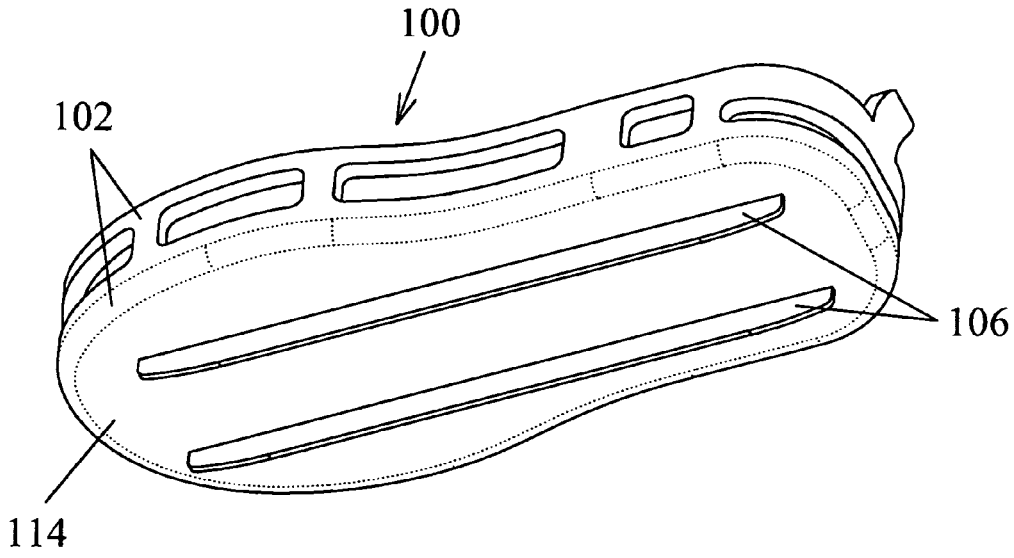
FIG. 6B is a perspective view of the bottom of the ice skate overshoe according to a preferred embodiment.

FIG. 6*b* is a perspective view of the bottom of the ice skate overshoe 100 according to an embodiment. The ice skate overshoe 100 comprises the upper portion 102, the upper portion base 114, the sole 104 (shown in FIG. 6*a*), and the blade 106. The upper portion base 114 is molded around the sole 104 to secure the sole 104 to the upper portion base 114.

Figure 6C:
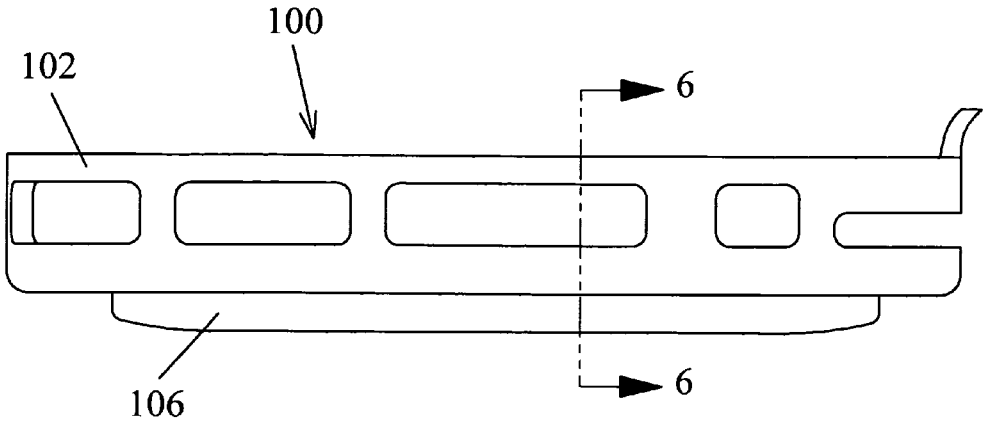
FIG. 6C is a side view of the ice skate overshoe according to a preferred embodiment.

FIG. 6*c* is a side view of the ice skate overshoe 100 according to a preferred embodiment. The ice skate overshoe 100 comprises the upper portion 102, the upper portion base 114 (shown in FIG. 6*d*), the sole 104 (shown in FIG. 6*d*), and the blade 106. The sole 104 further comprises a plurality of sole openings 174 (shown in FIG. 6*a*). The ice skate overshoe 100 is shown where a cross sectional cut is taken and viewed in FIG. 6*d*.

Figure 6D:
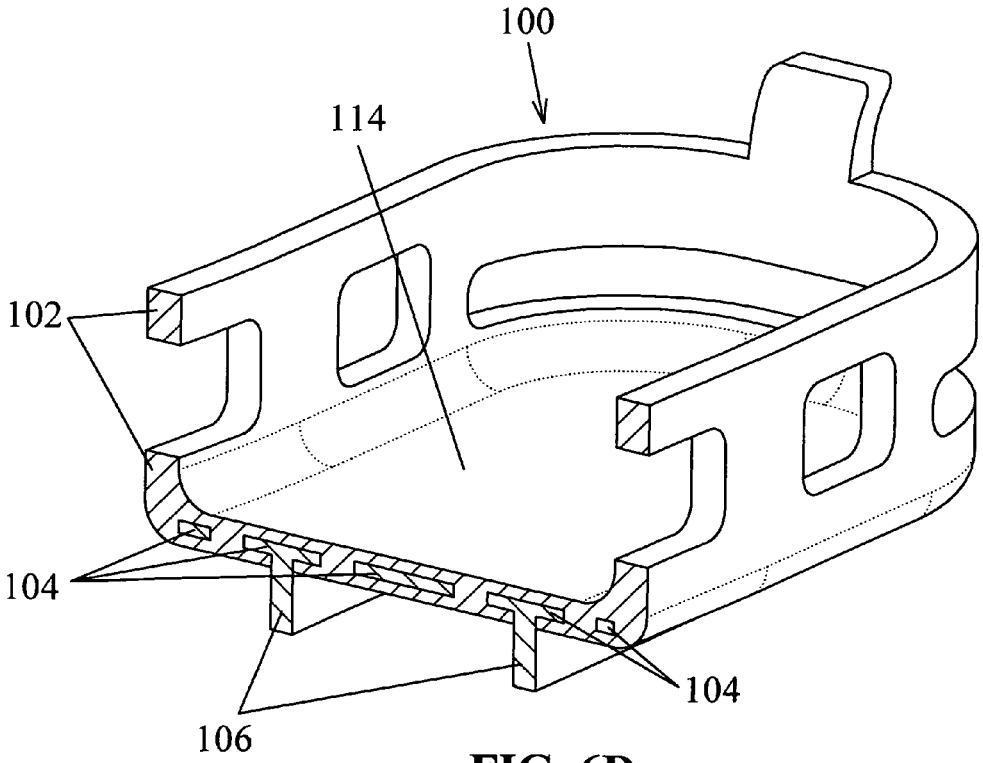
FIG. 6D is a perspective sectional view of the ice skate overshoe according to a preferred embodiment.

FIG. 6*d* is a perspective cross sectional view of the ice skate overshoe 100 according to an embodiment. The ice skate overshoe 100 comprises the upper portion 102, the sole 104, and the blade 106. The upper portion 102 further comprises the upper portion base 114. The upper portion 102 and the upper portion base 114 are preferably formed as a single part and manufactured from a moldable rubber. The sole 104 further comprises a plurality of the sole openings 174 (shown in FIG. 6*a*) configured to be penetrated by the material of the upper portion 102. The sole 104 and the blade 106 are shown formed as a single part. The sole 104 and the blade 106 may be formed separately and then attached together. The outer surfaces of the sole 104 and the outer surfaces of the sole openings 174 are secured to the upper portion 114. The material of the upper portion 114, and in more particular, the material of the upper portion base 114 is in contact with the surfaces of the sole 104 and is also penetrated into the sole openings 174. The sole 104 is shown molded and secured to the upper portion 102 with a molding process. A molding process may include an injection molding process. A vulcanization process may be included. These are known in the art. Other processes may be included.

Figure 7:
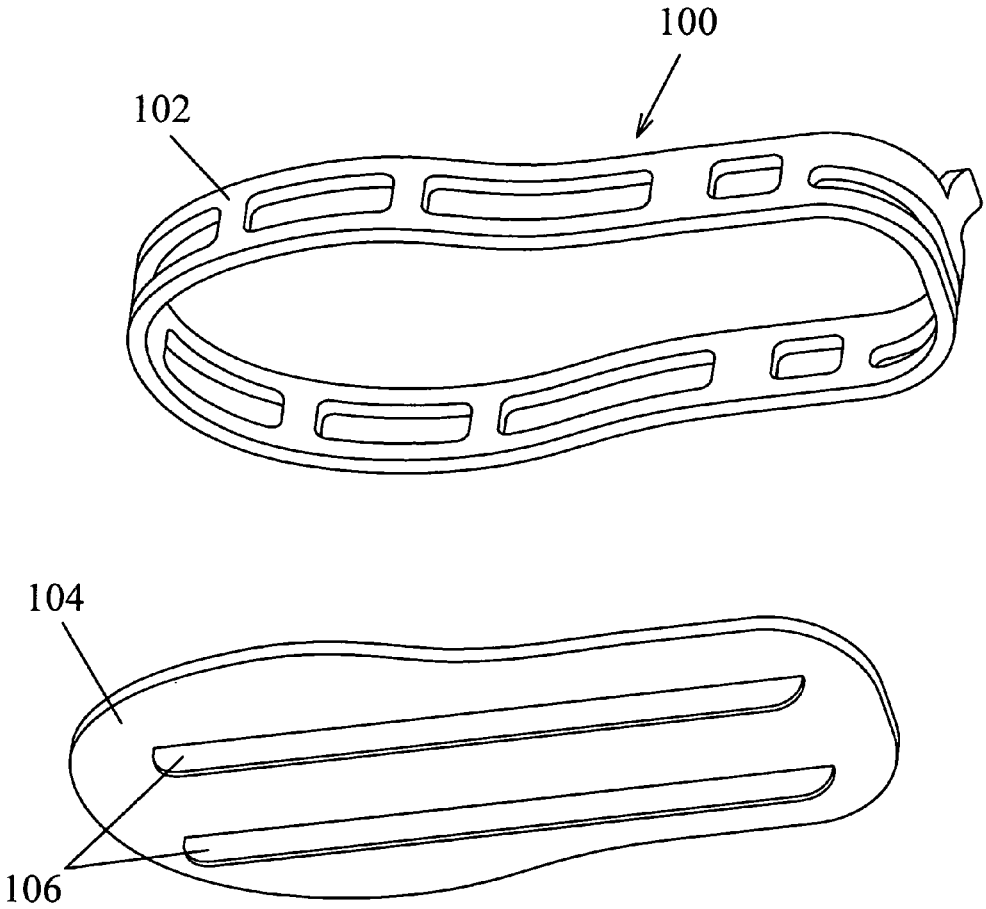
FIG. 7 is a perspective exploded view of the bottom of the ice skate overshoe according to a preferred embodiment.

Referring to FIG. 7, according to an embodiment, the ice skate overshoe 100 comprises the upper portion 102, the sole 104, and the blade 106. The upper portion 102 is shown not comprising the upper portion base 114. The upper portion 102 has an open bottom or base section. The sole 104 may be secured to the upper portion 102 with at least one of, an adhesive bonding process, a molding process, a vulcanization process or with an injection molding process. These are known in the art. Other processes may be included.

Figure 8:
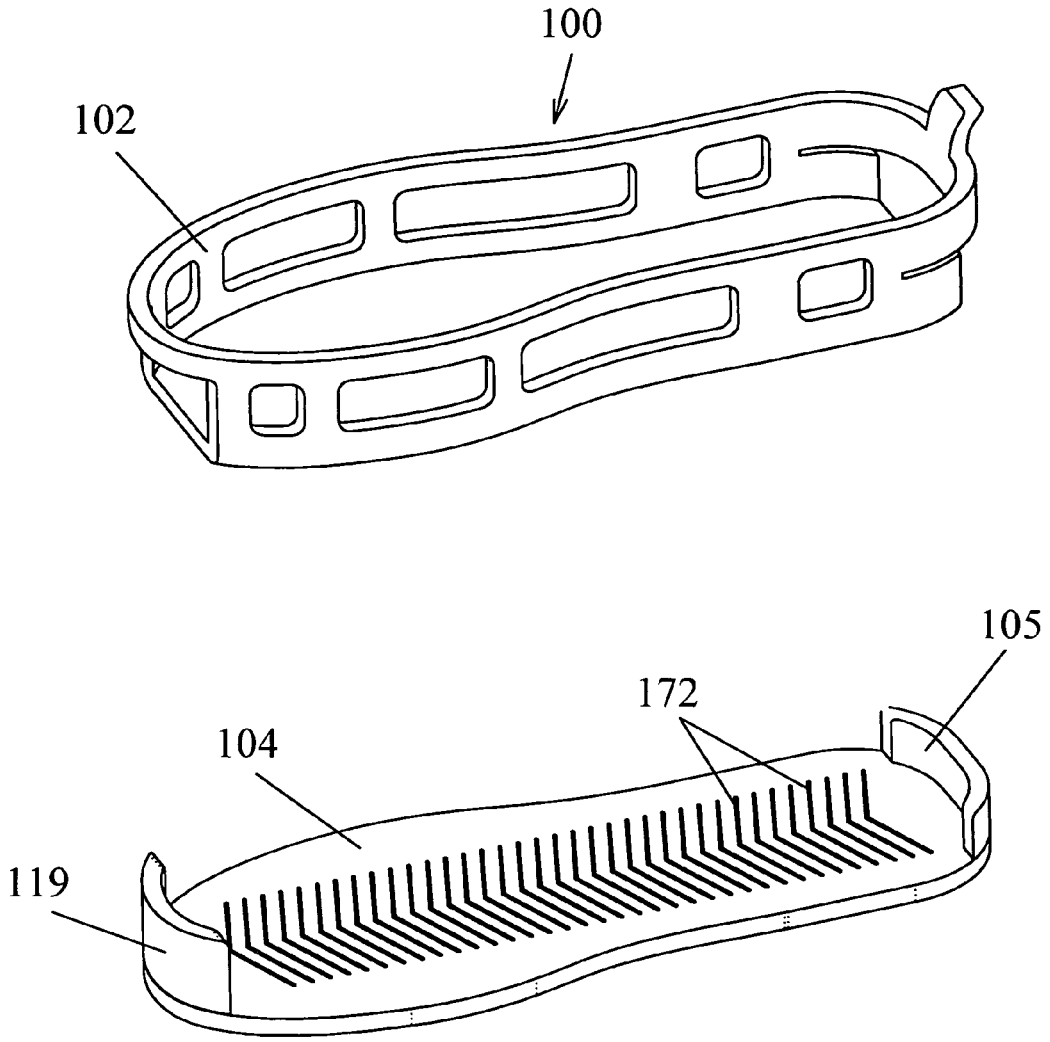
FIG. 8 is a perspective exploded view of the top of the ice skate overshoe according to a preferred embodiment.

Referring to FIG. 8, according to an embodiment, the ice skate overshoe 100 comprises the upper portion 102, the sole 104, and the blade 106 (blade shown in FIG. 7). The upper portion 102 is shown not comprising the upper portion base 114. The upper portion 102 has the open bottom or base section. The sole 104 may further comprise a heel support 105 configured to support the rear of the wearer's footwear 101 (not shown) and configured to support the wearer's footwear 101 from sliding rearward in relation to the sole 104. The sole 104 may further comprise a toe support 119 configured to support the front of the wearer's footwear 101 (not shown) and configured to support the wearer's footwear 101 from sliding frontward in relation to the sole 104. The sole 104, the heel support 105, and the toe support 119 are preferably formed as a single part manufactured from at least one of a metal, a plastic, and a composite. With the upper portion base 114 excluded from the upper portion, the footwear bottom 110 of the wearer's footwear 101 would be in contact with the top surface of the sole 104. The top surface of the sole 104 may comprise the raised protrusion 172, wherein the raised protrusion area 172 is configured capable to provide grip to the footwear bottom 110. The raised protrusion area 172 may be formed as a single part with the sole 104 and may be made of any material such as a plastic or a rubber. It may also be formed separately and from a different material from the sole 104. The sole 104 may be secured to the upper portion 102 with at least one of, an adhesive bonding process, a molding process, a vulcanization process or with an injection molding process. These are known in the art. Other processes may be included.

Figure 9A:
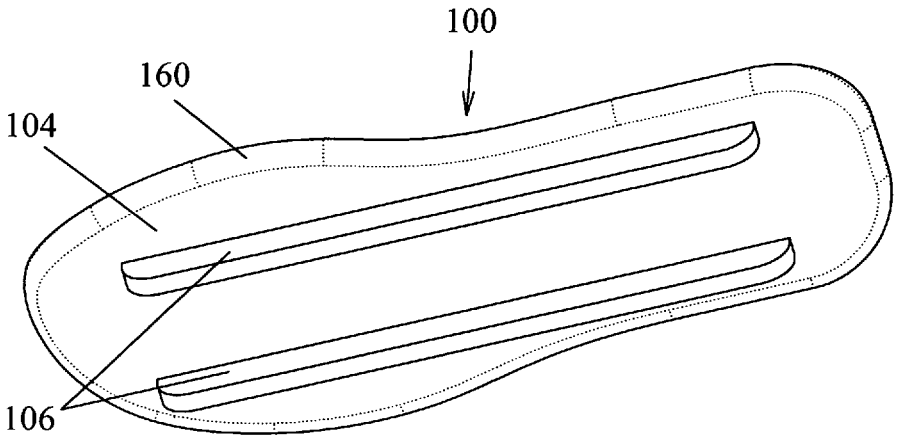
FIG. 9A is a perspective view of the bottom of the ice skate overshoe according to a preferred embodiment.
Figure 9B:
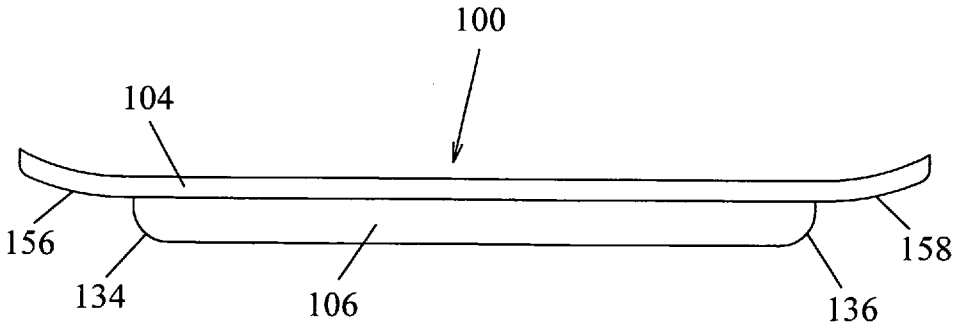
FIG. 9B is a side view of the ice skate overshoe according to a preferred embodiment.

Referring to FIGS. 9*a*, and 9*b*, according to an embodiment, the sole 104 of the ice skate overshoe 100 comprises an outer perimeter radius 160, and the blade 106. The sole 104 may further comprise a second leading edge radius 156 and a second trailing edge radius 158 which extend outwards and upwards from the sole 104 front and rear areas and are configured to increase the clearance of the sole 104 to the ice surface 120 (not shown). The sole 104 may be made of at least one of a metal, a plastic, a composite, and a rubber. Other known materials may be used. The blade 106 comprises a first leading edge radius 134 and a first trailing edge radius 136. The first leading edge radius 134 and the first trailing edge radius 136 are curvatures within the side profiles of the blade 106 which may extend as far from the center length of the blade 106 to the outward leading and trailing edges of the blade curving up towards the sole 104 at the ends of the blade 106. Blade 106 side profiles or curvatures are known in the art. Blade 106 mounting configurations in relation to the sole 104 are known in the art and may be included.

Figure 10A:
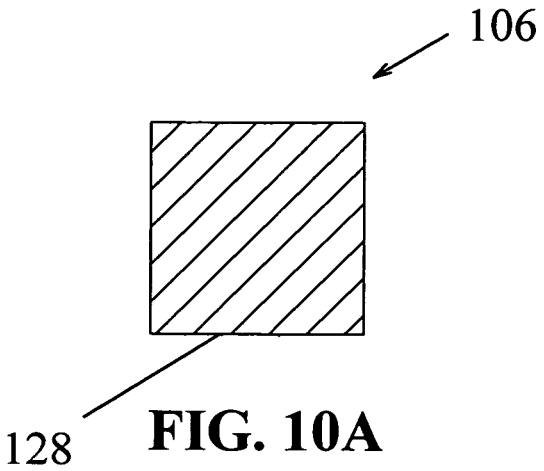
FIGS. 10A, 10B, and 10C are cross sectional views of the blade that illustrate the contact profile of the blade that may be used in various embodiments of the present invention.
Figure 10B:
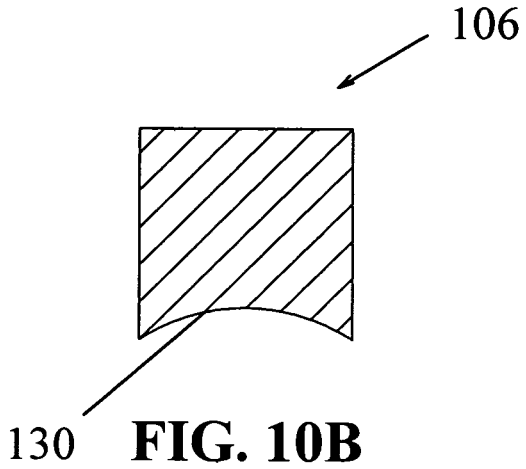
Figure 10C:
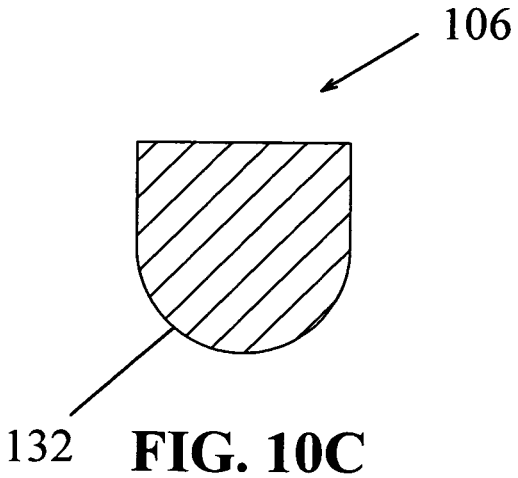

FIGS. 10*a*, 10*b*, and 10*c*, illustrate cross sectional profiles of the blade 106 that may be used in various embodiments of the present invention. FIG. 10*a* illustrates the blade 106 with a flat contact profile 128. FIG. 10*b* illustrates the blade 106 with a concave contact profile 130. FIG. 10*c* illustrates the blade 106 with a round contact profile 132. Cross sectional profiles of the blade 106 are generally the cross sectional profiles of the blade 106 in contact with the ice surface 120 (ice surface shown in FIG. 1*c*). These profiles are known in the art. Any known profile may be included.

Figure 11A:
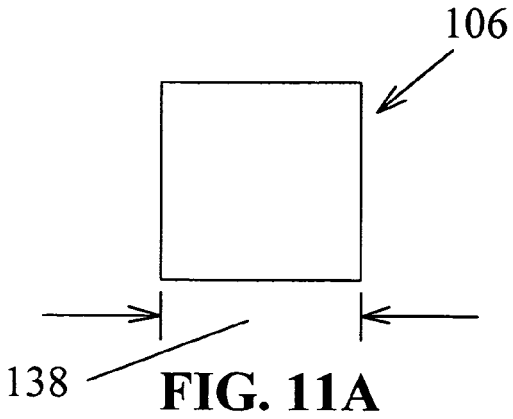
FIG. 11A is a cross sectional view of the blade that illustrates the width of the blade that may be used in various embodiments of the present invention.
Figure 11B:
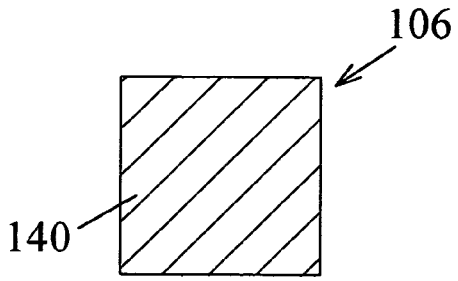
FIGS. 11B, 11C, 11D, 11E, and 11F are cross sectional views of the blade that illustrate the material of the blade that may be used in various embodiments of the present invention.
Figure 11C:
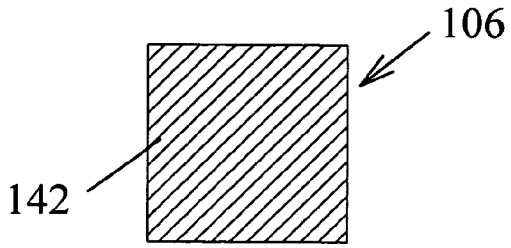
Figure 11D:
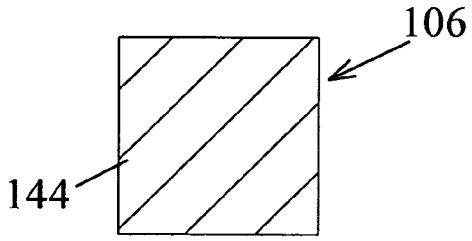
Figure 11E:
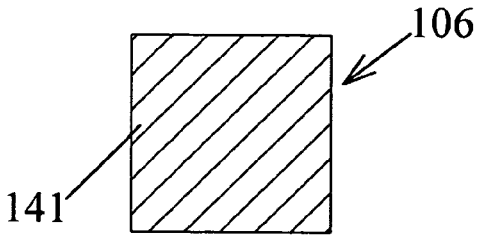
Figure 11F:
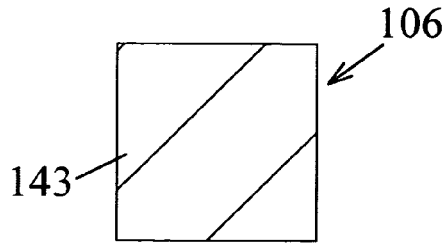

FIGS. 11*a*, 11*b*, 11*c* and 11*d* illustrate cross sectional views of the blade 106 according to various embodiments of the present invention. FIG. 11*a* illustrates the blade 106 comprising a blade width measurement 138. The blade width measurement 138 is the cross sectional width of the blade 106 which is preferably between approximately two millimeters and fifteen millimeters but not limited to this. The blade width measurement 138 may also include a measurement that is variable in width. The blade width measurement 138 may also include a measurement that is wider than fifteen millimeters. An example of the blade 106 with the blade width measurement 138 which is relatively wide would be the blade width measurement 138 of approximately one hundred and twenty five millimeters which may be made of a plastic which may include the concave contact profile 130 which may include approximately a two millimeter outer portion of the blade 106 which may be made of a metal 140. This approximate configuration is only an example of a combination of the blade width measurement 138 with the blade 106 material used. FIG. 11*b* illustrates the blade 106 made of the metal 140. FIG. 11*c* illustrates the blade 106 made of a spring metal 142. Objects made of the spring metal 142 return to their original shape despite significant bending or twist. Spring metal 142 is known in the art. FIG. 11*d* illustrates the blade 106 made of a stainless steel metal 144. FIG. 11*e* illustrates the blade 106 made of a plastic 141. FIG. 11*f* illustrates the blade 106 made of a composite 143. The blade 106 may be constructed or made of virtually any known or available material. The blade 106 may comprise any combination of the materials mentioned and may include any known materials. The blade 106 may also include a coating or a treatment on at least a portion of its surface which configures it with at least one of, an additional hardness to its surface or a reduction in friction to its surface which may be in contact with the ice surface 120. This coating may include a metal coating but not limited to this.

Figure 12A:
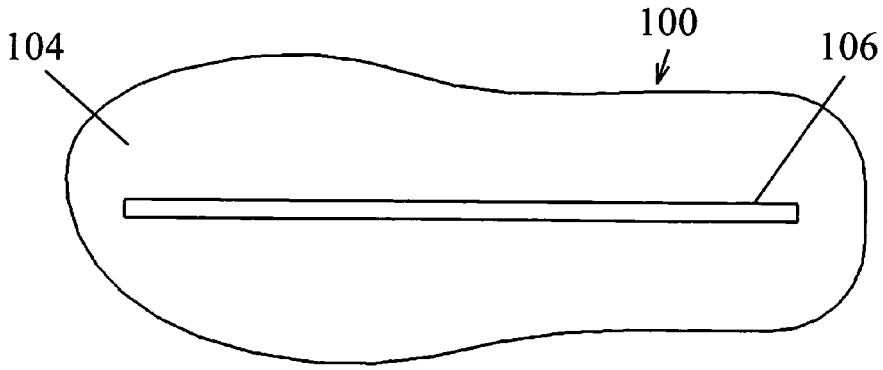
FIGS. 12A, 12B, and 12C are bottom views of the ice skate overshoe according to a preferred embodiment.
Figure 12B:
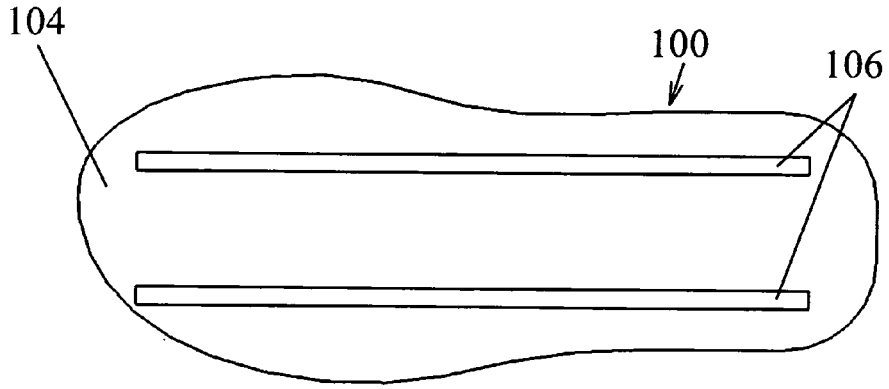
Figure 12C:
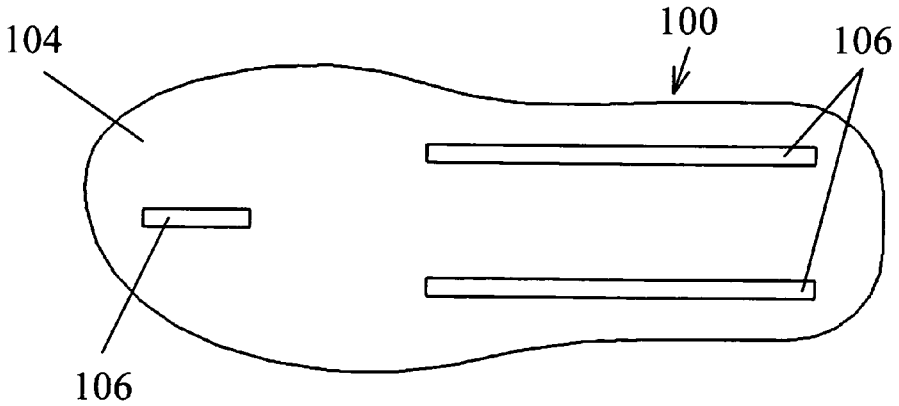

FIGS. 12*a*, 12*b*, and 12*c*, illustrate the blade 106 of the sole 104 arranged in different configurations. FIG. 12*a* illustrates one of the blade 106 and its approximate location in relation to the sole 104. FIG. 12*b* illustrates two of the blade 106 and its approximate location in relation to the sole 104. FIG. 12*c* illustrates three of the blade 106 and its approximate location in relation to the sole 104. It is preferable that the ice skate overshoe 100 comprises two of the blade 106 located substantially parallel to each other and substantially apart from each other and configured capable to skate on the ice surface 120 (not shown). The blade 106 in the above figures is located parallel to a center line of the ice skate overshoe 100, the centerline is located from front to rear of the ice skate overshoe 100. This is conventional and is known in the art.

Figure 13:
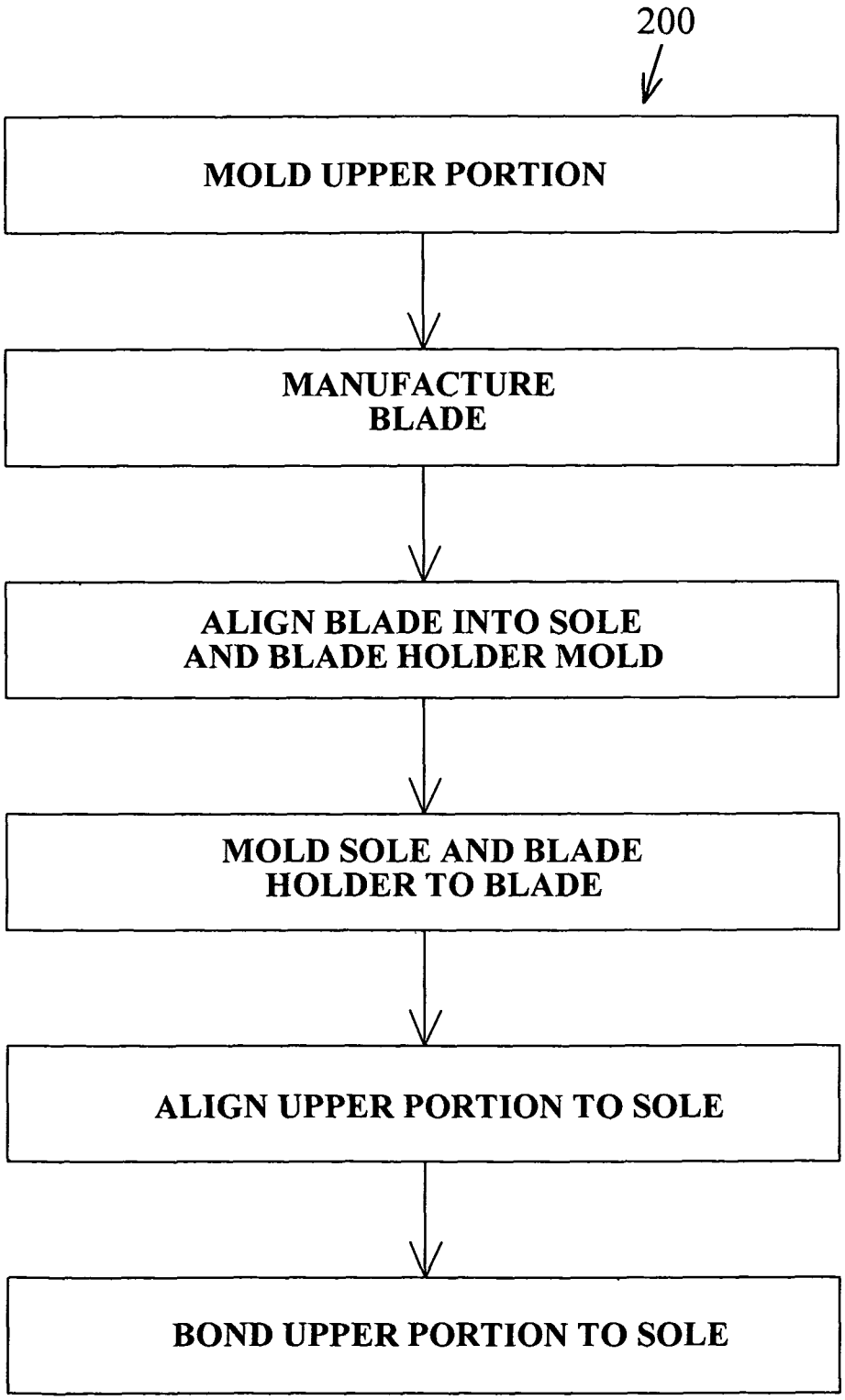
FIG. 13 is a flow diagram illustrating a method for manufacturing the ice skate overshoe in accordance with embodiments of the present invention.

FIG. 13 is a flow diagram illustrating a method for manufacturing the ice skate overshoe 100 in accordance with embodiments of the present invention. Following a flow diagram 200, the upper portion 102 is molded preferably with an injection molding process, the blade 106 is manufactured, the blade 106 is aligned into a sole and blade holder mold, the sole 104 and the blade holder 112 are molded and the blade holder 112 is molded to the blade 106 to secure the blade 106 to the blade holder 112, the upper portion 102 is aligned to the sole 104, and the upper portion 102 is bonded to the sole 104.

Figure 14:
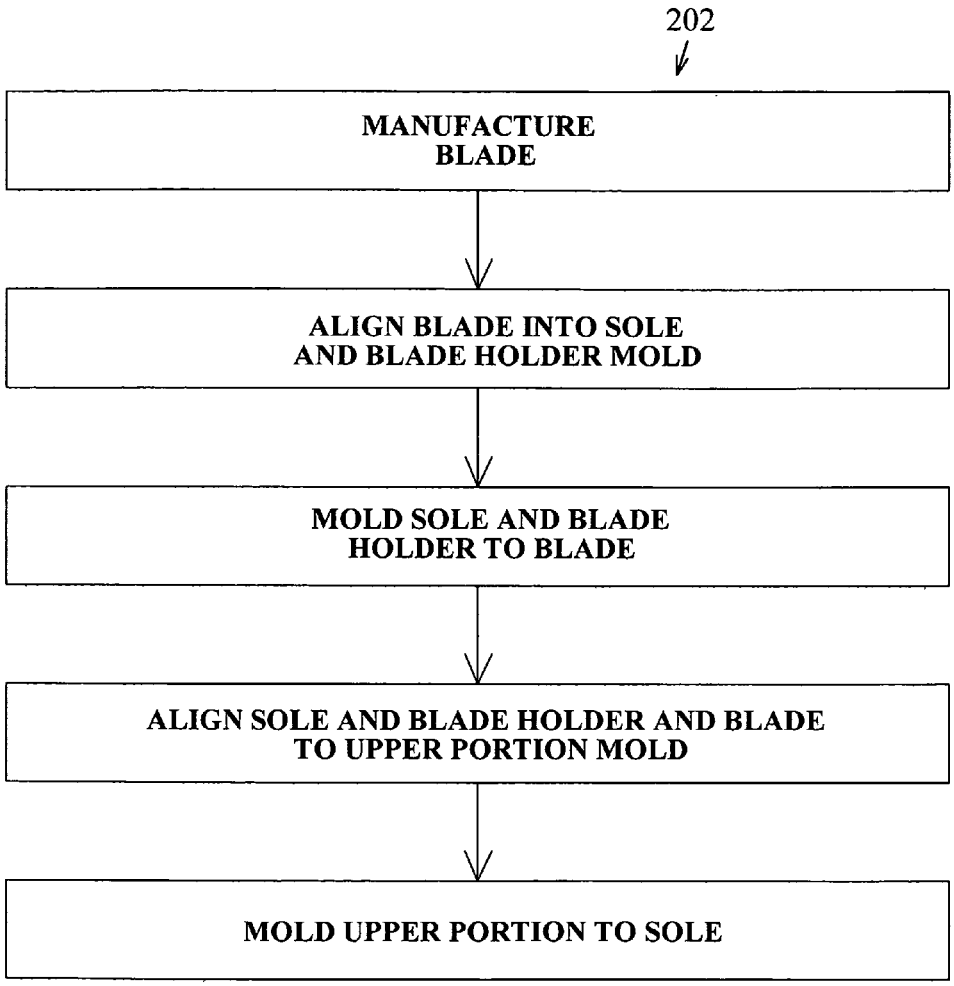
FIG. 14 is a flow diagram illustrating a method for manufacturing the ice skate overshoe in accordance with embodiments of the present invention.

FIG. 14 is a flow diagram illustrating a method for manufacturing the ice skate overshoe 100 in accordance with embodiments of the present invention. Following a second flow diagram 202, the blade 106 is manufactured, the blade 106 is aligned into a sole and blade holder mold, the sole 104 and the blade holder 112 are molded and the blade holder 112 is molded to the blade 106 to secure the blade 106 to the blade holder 112, the sole 104, the blade holder 112, and the blade 106, are aligned to the upper portion mold, the upper portion 102 is molded to the sole 104 preferably with an injection molding process.

Of course, the various aspects of the embodiments shown in FIGS. 1*a*-14 may be mixed and matched as desired, where possible. Further, the present invention is not limited to only those embodiments shown.

I claim:

1. An ice skate overshoe, comprising:

an upper portion;

a sole connected to the upper portion;

a blade connected to the sole;

wherein the upper portion is made substantially of stretchable rubber;

wherein the upper portion is configured stretchable and capable to return substantially to its original state;

wherein the upper portion comprises a first opening configured as an entrance for a footwear;

wherein the upper portion is configured to stretch over the footwear to secure the ice skate overshoe to the footwear;

wherein, the sole is configured to support a footwear bottom;

wherein the sole is configured substantially rigid;

wherein the blade is configured substantially rigid;

wherein the blade is rigidly attached to the sole;

wherein the blade is configured operable to engage with an ice surface;

wherein the ice skate overshoe is configured to wear over the footwear;

wherein the ice skate overshoe is configured operable to skate on the ice surface;

wherein the upper portion comprises an upper portion base formed as a single part with the upper portion and manufactured from a moldable rubber;

wherein the upper portion is molded to the sole and wherein during the molding process, such that the sole is substantially enclosed or encompassed by the material of the upper portion to secure the sole to the upper portion; and wherein the sole comprises a plurality of sole openings, the upper portion extends through the sole openings which interconnects the upper portion through the sole to further secure the sole to the upper portion.

2. The ice skate overshoe as claimed in claim 1, wherein the upper portion is formed substantially as a single part manufactured from a moldable rubber.

3. The ice skate overshoe as claimed in claim 1, wherein the upper portion is an open frame construction, wherein the upper portion comprises a plurality of second openings configured to add stretchability to the upper portion.

4. The ice skate overshoe as claimed in claim 1, wherein the upper portion is made substantially of a thermoplastic elastomer.

5. The ice skate overshoe as claimed in claim 1, wherein the upper portion comprises a front toe portion formed as a single part with the upper portion and manufactured from a moldable rubber, and wherein the front toe portion is configured to stretch over the toe area of the footwear.

6. The ice skate overshoe as claimed in claim 1, wherein the ice skate overshoe comprises at least two of the blade located substantially parallel to each other and configured capable to skate on the ice surface.

7. The ice skate overshoe as claimed in claim 1, wherein the sole and the blade are formed as a single part manufactured from at least one of a metal, a plastic, and a composite.

* * * * *